US005410937A

United States Patent [19]

Okamoto et al.

[11] Patent Number: 5,410,937

[45] Date of Patent: May 2, 1995

[54] SUPPORTING MECHANISM FOR A SOUND GENERATOR OF A MUSICAL INSTRUMENT

[75] Inventors: Tomio Okamoto; Junji Fujii, both of Shizuoka, Japan

[73] Assignee: Yamaha Corporation, Shizuoka, Japan

[21] Appl. No.: 151,530

[22] Filed: Nov. 12, 1993

[30] Foreign Application Priority Data

Nov. 13, 1992 [JP] Japan ..... 4-304165

[51] Int. Cl.[6] ..... G10D 13/08

[52] U.S. Cl. ..... 84/403; 84/406; 116/169; 248/222.1; D17/22

[58] Field of Search ..... 84/402, 403, 406, 404, 84/405, 407, 453; D17/22, 99; 116/148, 169; 248/222.1; 403/356, 315, 319, 322, 324, 330

[56] References Cited

U.S. PATENT DOCUMENTS 1,100,671 6/1914 Deagan ..... 84/403
1,307,467 6/1919 Van Heusen ..... 116/169
2,254,488 9/1941 Miller ..... 84/405
5,337,989 8/1994 Apple ..... 248/222.1

*Primary Examiner*—M. L. Gellner
*Assistant Examiner*—Cassandra C. Spyrou
*Attorney, Agent, or Firm*—Ostrolenk, Faber, Gerb & Soffen

[57] ABSTRACT

In construction of a supporting mechanism for mounting a tubular tone generator to a stand of a percussive musical instrument, a holder shaft insertable into the sound generator is provided at its lower end with a pivotal lock bar of a biased mass distribution and a slidable coupled stopper to hold the lock bar at a prescribed angular position. When inserted into the sound generator, the lock bar turns automatically to assume the proscribed angular position due to the biased mass distribution and locks the holder shaft to the tone generator. Absence of the conventional tension wire binding system allows free choice in sound characteristics, simplified easy mounting operation and high mechanical durability even under vibratory conditions during performance.

2 Claims, 5 Drawing Sheets

SUPPORTING MECHANISM FOR A SOUND GENERATOR OF A MUSICAL INSTRUMENT

BACKGROUND OF THE INVENTION

The present invention relates to a supporting mechanism for a sound generator of a musical instrument, and more particularly relates to improvement in acoustic performance and operability of a mechanism for mounting a tubular sound generator to a stand of a percussive musical instrument such as a chime, i.e. a tubular bell.

A percussive musical instrument of the above-described type generally includes a number of juxtaposed, tubular sound generators, i.e. sound tubes, mounted to a stand which is made up of a pair of side posts and a hanger bar horizontally spanning top ends of the post.

In the construction of a conventional supporting mechanism for mounting each sound tube to the stand, a tension wire is used. More specifically, a pair of radial holes are formed diametrically through the top end of the sound tube and the tension wire past through the radial holes is fixed to a hanger pin arranged on the hanger bar. Stated otherwise, each sound tube is bound at its top end to the hanger bar by assistance of the tension wire and the edge of a head plug at the top end is struck with a hammer.

Such a conventional construction of the supporting mechanism, however, is inevitably accompanied with drawbacks in acoustic performance and operability due to presence of the radial holes and use of the tension wire made of steel.

It is well known that tone quality and scan of sounds generated by a percussive musical instrument such as a chime is much swayed by the mechanical design of its sound tubes such as the length, the diameter and the wall thickness. Subtle change in mechanical design and/or beating position would wield a great influence on the nature of sounds to be generated.

In the case of the conventional supporting mechanism, presence of the radial holes for the binding wire tends to pose uncontrollable influence on the quality of sounds. In addition, the above-described binding system by the tension wire limits the mounting position of each sound tube to the stand and such a positional limit does not allow free choice in beating position around the edge of the head plug. As a consequence, choice in tone colour of sounds generated is much limited.

Further, it is highly difficult in practice to pull the thin steel wire at a high tension for mounting of each sound tube to the hanger bar of the stand. In addition, the tightly scanned wire tends to break during performance of the percussive musical instrument.

SUMMARY OF THE INVENTION

It is thus the primary object of the present invention to provide a sound tube supporting mechanism which allows increased freedom in choice of tone colour of sounds to be generated.

It is another object of the present invention to remove uncontrollable factors in mechanical design of a sound generator whilst allowing its easy mounting to a stand of a percussive musical instrument.

It is the other object of the present invention to provide a sound tube supporting mechanism which is much endurable against long use.

In accordance with the present invention, a holder shaft is designed for downward insertion into an associated tone generator, a lock bar is pivoted to the lower end of the holder shaft at a position off its center of gravity, and a stopper is axially, slidably coupled to the holder shaft for holding the lock bar at a prescribed position about its point of pivot.

DESCRIPTION OF THE PREFERRED EMBODIMENTS

Figure 1:
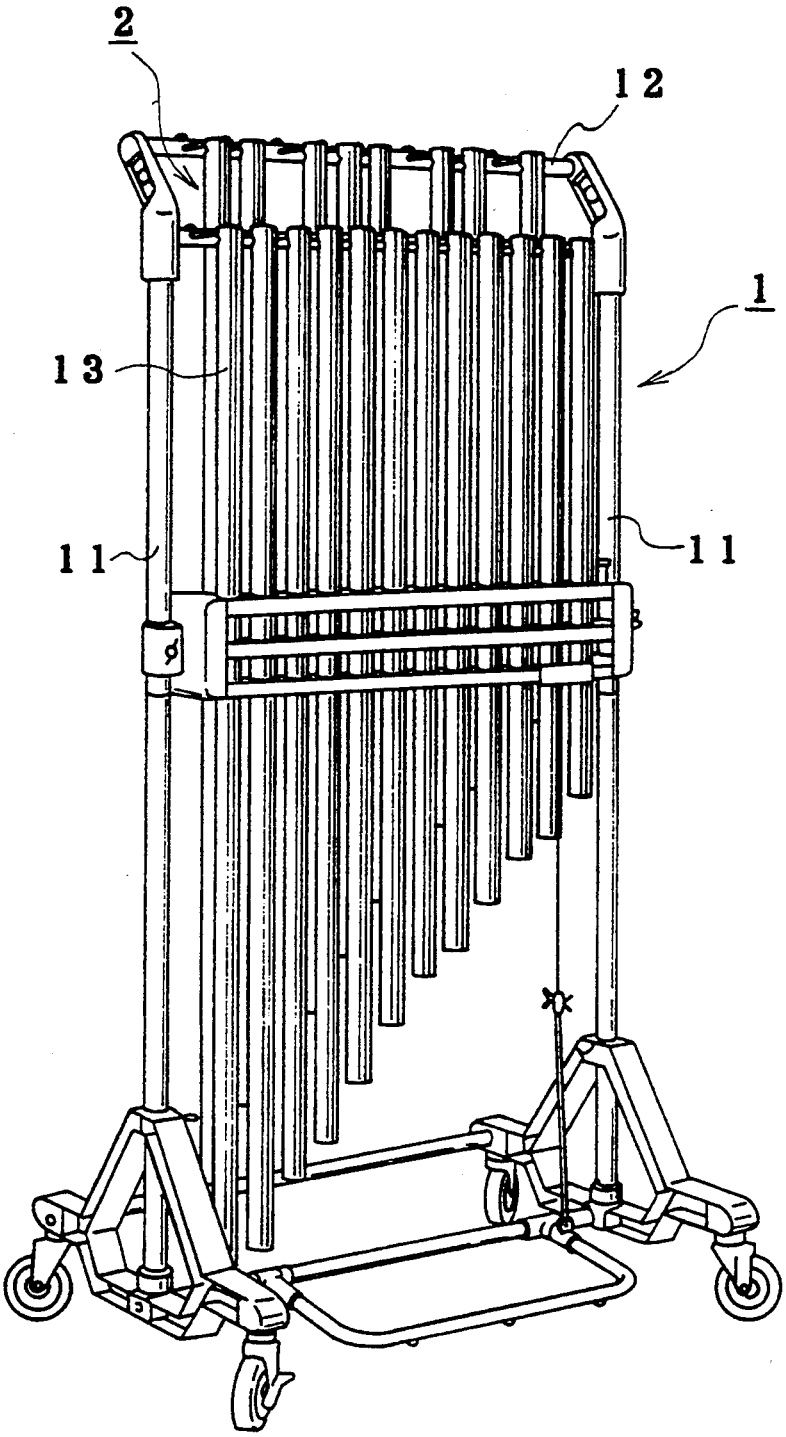
FIG. 1 is a perspective view of a chime employing the sound tube supporting mechanism in accordance with the present invention.
Figure 3A:
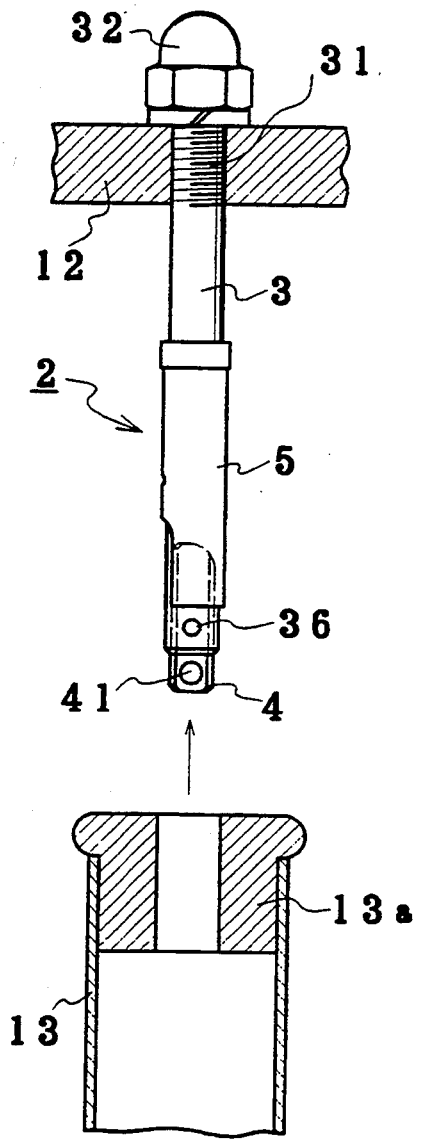

The supporting mechanism in accordance with the present invention is attached to a stand of a percussive musical instrument such as, for example, shown in FIG. 1 in which the stand 1 is made up of a pair of side posts 11 and a hanger bar 12 horizontally spanning the top ends of the side posts 11. A number of sound tubes 13, i.e. sound generators, are mounted to the stand 1 in a juxtaposed arrangement. That is, each sound tube 13 is coupled at its top end to the hanger bar 12 of the stand 1 by assistance of a supporting mechanism 2 in accordance with the present invention. The construction of the top end of the sound tube 13 is seen in FIG. 3A. The top end of the sound tube 13 is closed by a tubular head plug 13a which has an exposed outer flange adapted for beating for sound generation.

Figure 2A:
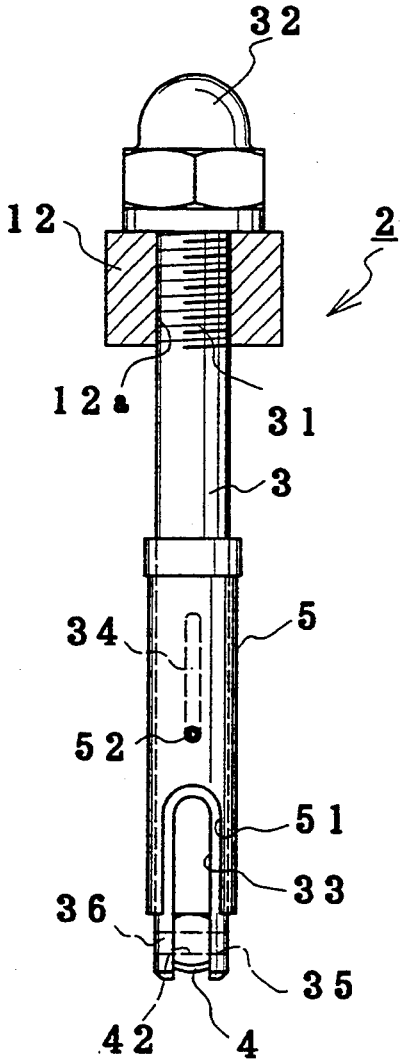
FIGS. 2A and 2B are side and front views, partly in section, of one embodiment of the sound tube supporting mechanism in accordance with the present inventions, and FIGS. 3A, 3B, 3C, 3D, 3E, 3F and 3G front views, partly in section, of the sound tube supporting mechanism shown in FIGS. 2A and 2B in various sequential phases of its operation.
Figure 2B:
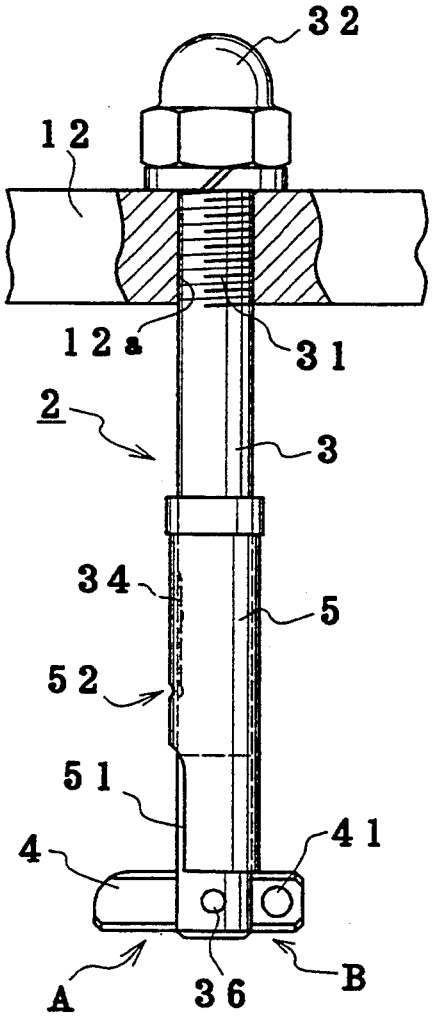

The construction of the supporting mechanism 2 is shown in detail in FIGS. 2A and 2B. In summary, the supporting mechanism 2 includes a holder shaft 3, a lock bar 4 pivoted to the holder shaft 3 and a stopper 5 inserted over the holder shaft 3, all preferably made of a metallic material.

The holder shaft 3 takes the form of an elongated cylindrical body having a diameter of, e.g. 10 mm. A screw 31 is formed near the top end of the holder shaft 3 for screw engagement with a threaded hole 12 a vertical formed through the hanger bar 12 at a position corresponding to an associated sound tube 13. The screw engagement is fastened by a fixer nut 32 attached to the top end of the holder shaft 3.

A longitudinal cutout 33 with a hemicircular top end is formed near the lower end of the holder shaft 3. At a position somewhat above the cutout 33 is formed a slide guide groove 34 in the body of the holder shaft 3 whilst extending in the longitudinal direction of the latter. The lower end of the holder shaft 3 is provided with a diametral, transverse hole 35 for reception of a rotary shaft 36.

The lock bar 4 is pivoted to the lower end of the holder shaft 3 via the rotary shaft 36. To this end, a transverse hole 42 is formed in the lock bar 4 for reception of the rotary shaft 36 on the holder shaft 3.

The lock bar 4 takes the form of a short bar of a substantially rectangular cross section but its upper and lower sides a somewhat chamfered. One end of the lock bar 4 is provided with a through hole 41 in order to provide a biased mass distribution. As a result, the lock bar 4 is made up of a heavier side A and a lighter side B with its point of pivot at the midway between the two sides. Stated other wise, the lock bar 4 is pivoted to the holder shaft 3 at a position off its own center of gravity.

The stopper 5 is given in the form of a hollow cylinder whose inner diameter is slightly larger than the outer diameter of the holder shaft 3. The lower end of the stopper 5 is provided with a longitudinal cutout 51 having a hemicircular top end. The stopper 5 is inserted over the holder shaft 3 so that its cutout 51 roughly mate the cutout 33 formed in the holder shaft 3. In order to keep this mating and a limited slidable combination, an inner projection 52 is formed on the stopper 5 in engagement with the slide guide groove 34 formed in the holder shaft 3.

The sequential operation of the above-described supporting mechanism 2 will now be explained in reference to FIGS. 3A through 3G. Mounting of a sound tube to the stand is carried out as shown in FIGS. 3A to 3C.

In the phase shown in FIG. 3A, a sound tube 13 is located just below the lower end of an associated supporting mechanism 2 already fixed to the hanger bar 12 of the stand 1. In this position, the lock bar 4 is manually held vertically so that the lighter side B is directed downwards and the sound tube 13 is brought upwards with its axis roughly in line with the axis of the holder shaft 3.

Figure 3B:
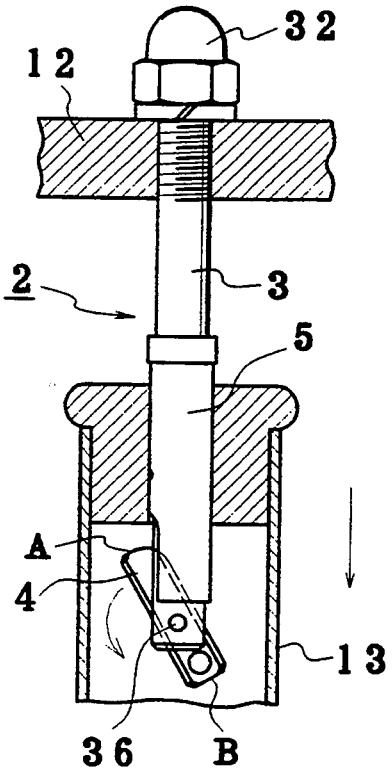

In the phase shown in FIG. 3B, the lower section of the supporting mechanism 2 is inserted into the sound tube 13 with cancellation of manual hold on the lock bar 4. Then, inside the sound tube 13, the lock bar 4 automatically turns counterclockwise in the illustration about its point of pivot by the rotary shaft 36 due to its biased mass distribution. Application of slight vibration to the supporting mechanism 2 at its insertion may assist automatic turning of the lock bar 4.

Figure 3C:
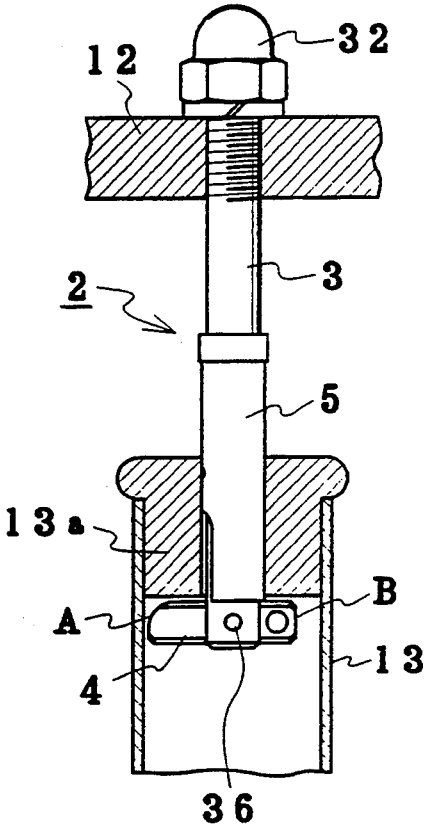

As the lock bar 4 assumes a horizontal position as shown in FIG. 3C, its further turning is banned by the stopper 5. By cancellation of manual hold on the sound tube 13, the head plug 13*a* on the sound tube 13 is locked by the lock bar 4 on the supporting mechanism 2 and the entire system is now ready for performance.

Figure 3D:
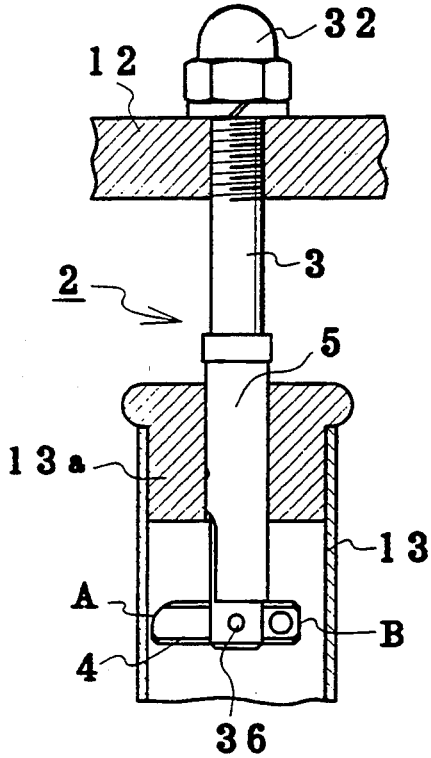

Even when the sound tube 13 is lifted as shown in FIG. 3D, the horizontal position of the lock bar 4 is maintained by the stopper 5 on the holder shaft 3 and, as a consequence, no accidental fall of the sound tube 13 from the stand occurs.

Figure 3E:
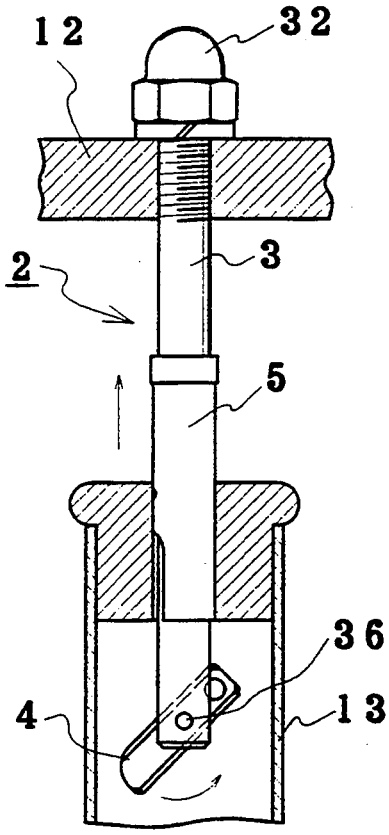
Figure 3F:
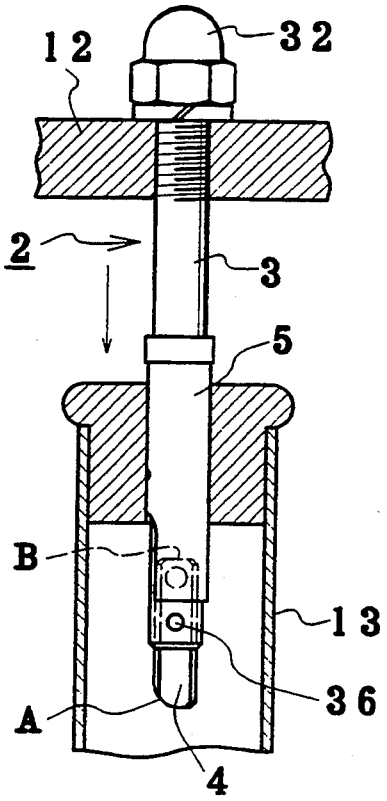
Figure 3G:
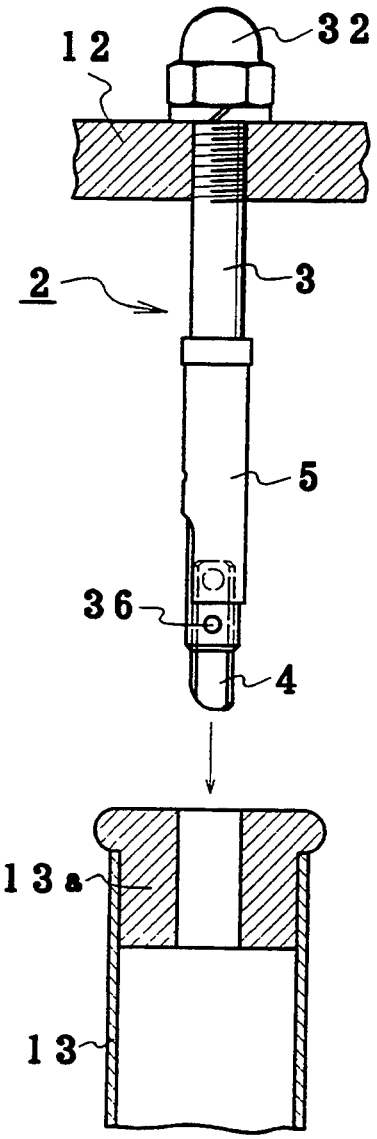

Dismounting of a sound tube from the stand is carried out as shown in FIGS. 3E to 3G. In the phase shown in FIG. 3E, the sound tube 13 is manually lifted and, concurrently, the stopper 5 is manually slid upwards. Upward sliding of the stopper 5 is automatically limited due to engagement of its inner projection 52 with the slide guide groove 34 formed in the holder shaft 3. Cancellation of the lock by the stopper 5 allows automatic counterclockwise turning of the lock bar 4 due to its biased mass distribution.

As a result of this turning, the lock bar 4 assumes a vertical position shown in FIG. 3F with its heavier side A being directed downwards. By releasing the stopper 5 from manual hold under this condition, the stopper 5 slides downward in order to keep the lock bar 4 in the vertical position. Thanks to this lock by the stopper 5, the vertical position of the lock bar 4 is maintained even against some extent of vibrations.

Finally, by .manually pulling the sound tube 13 downwards, the sound tube 13 is fully disengaged from the supporting mechanism 2 as shown in FIG. 3G.

In accordance with the present invention, no change in design of each sound tube, i.e. each sound generator, assures no presence of uncontrollable influence on the quality of sounds to be generated. No use of any tension wire binding allows quite free choice in beating position and, as a consequence, poses no limitation to choice in tone colour. Soft manual operation needed to move the stopper combined with automatic turning of the lock bar greatly simplifies mounting and dismounting of the sound tube with respect to the stand. Removal of the conventional tension wire binding system well raises the mechanical durability of the supporting mechanism.

We claim:

1. A supporting mechanism for a sound generator of a musical instrument comprising a holder shaft having an upper section adapted for mounting to a stand of said musical instrument and a lower section adapted for downward insertion into an axial bore of said sound generator, a lock bar pivoted, at a position off its own center of gravity, to a lower end of said holder shaft, and a stopper axially, slidably coupled to said holder shaft in an arrangement able to hold said lock bar at a prescribed angular position about its point of pivot.

2. A supporting mechanism as claimed in claim 1 in which said holder shaft is provided with a guide groove of a limited length, and said stopper is inserted over said holder shaft and provided with an inner projection in slidable engagement with said guide groove.

* * * * *